US010930464B2

(12) United States Patent
Takman et al.

(10) Patent No.: US 10,930,464 B2
(45) Date of Patent: Feb. 23, 2021

(54) VAPOUR MONITORING

(71) Applicant: Excillum AB, Kista (SE)

(72) Inventors: Per Takman, Kista (SE); Tomi Tuohimaa, Kista (SE)

(73) Assignee: EXCILLUM AB, Kista (SE)

( * ) Notice: Subject to any disclaimer, the term of this patent is extended or adjusted under 35 U.S.C. 154(b) by 11 days.

(21) Appl. No.: 16/499,582

(22) PCT Filed: Mar. 27, 2018

(86) PCT No.: PCT/EP2018/057715
§ 371 (c)(1),
(2) Date: Sep. 30, 2019

(87) PCT Pub. No.: WO2018/184904
PCT Pub. Date: Oct. 11, 2018

(65) Prior Publication Data

US 2020/0058461 A1 Feb. 20, 2020

(30) Foreign Application Priority Data

Apr. 5, 2017 (EP) ..... 17165059

(51) Int. Cl.
*H01J 35/08* (2006.01)
*H05G 1/26* (2006.01)
(Continued)

(52) U.S. Cl.
CPC ..... *H01J 35/116* (2019.05); *H05G 1/265* (2013.01); *H05G 1/36* (2013.01); *H01J 35/147* (2019.05);
(Continued)

(58) Field of Classification Search
CPC ..... H01J 35/116; H01J 35/16; H01J 35/147; H01J 2235/082; H01J 2235/20; H05G 1/265; H05G 1/36
See application file for complete search history.

(56) References Cited

U.S. PATENT DOCUMENTS

2008/0181365 A1 7/2008 Matoba
2013/0313423 A1 11/2013 Umstadter
(Continued)

FOREIGN PATENT DOCUMENTS

EP 3261110 A1 12/2017
WO 2010083854 A1 7/2010
WO 2013185829 A1 12/2013

OTHER PUBLICATIONS

International Preliminary Report on Patentability (PCT/IPEA/409) dated Jul. 18, 2019, by the European Patent Office as the International Preliminary Examining Authority for International Application No. PCT/EP2018/057715.
(Continued)

*Primary Examiner* — Chih-Cheng Kao
(74) *Attorney, Agent, or Firm* — Buchanan Ingersoll & Rooney P.C.

(57) ABSTRACT

A method for generating X-ray radiation, the method including providing a liquid target in a chamber, directing an electron beam towards the liquid target such that the electron beam interacts with the liquid target to generated X-ray radiation, estimating a number of particles produced from the interaction between the electron beam and the liquid target by measuring a number of positively charged particles in the chamber and eliminating a contribution from scattered electrons to the estimated number of particles, and controlling the electron beam, and/or a temperature in a region of the liquid target in which the electron beam interacts with
(Continued)

the target, such that the estimated number of particles is below a predetermined limit. Also, a corresponding X-ray source.

15 Claims, 4 Drawing Sheets

(51) Int. Cl.
*H05G 1/36* (2006.01)
*H01J 35/14* (2006.01)
*H01J 35/16* (2006.01)

(52) U.S. Cl.
CPC ..... *H01J 35/16* (2013.01); *H01J 2235/082* (2013.01); *H01J 2235/20* (2013.01)

(56) References Cited

U.S. PATENT DOCUMENTS

| | | | | |
|---|---|---|---|---|
| 2015/0179388 | A1* | 6/2015 | Hemberg ..... | H01J 35/08<br>378/138 |
| 2019/0131103 | A1* | 5/2019 | Tuohimaa ..... | H01J 35/20 |

OTHER PUBLICATIONS

International Search Report (PCT/ISA/210) and Written Opinion (PCT/ISA/237) dated Jul. 18, 2018, by the European Patent Office as the International Searching Authority for International Application No. PCT/EP2018/057715.

Otendal et al., "Stability and debris in high-brightness liquid-metal-jet-anode microfocus x-ray sources", Journal of Applied Physics, vol. 101, No. 2, Jan. 2007, pp. 26102-026102.

* cited by examiner

VAPOUR MONITORING

TECHNICAL FIELD

The invention disclosed herein generally relates to electron impact X-ray sources comprising a liquid anode. In particular, the invention relates to techniques for controlling the X-ray source based on an estimated number of particles produced from the interaction between the electron beam and the liquid target.

BACKGROUND

Systems for generating X-rays by irradiating a liquid target are described in the applicant's International Application PCT/EP2009/000481. In these systems, an electron source comprising a high-voltage cathode is utilised to produce an electron beam that impinges on a liquid target. The target is preferably formed by a jet of liquid metal provided inside a vacuum chamber. The position in space wherein a portion of the liquid jet is hit by the electron beam during operation is referred to as the interaction region or interaction point. The X-ray radiation generated by the interaction between the electron beam and the liquid jet may leave the vacuum chamber through an X-ray window separating the vacuum chamber from the ambient atmosphere.

During operation of the X-ray source, free particles, including debris and vapour from the liquid jet, tend to deposit on the window and the cathode. This causes a gradual degradation of the performance of the system, as deposited debris may obscure the window and reduce the efficiency of the cathode. In PCT/EP2009/000481, a heat source is employed to evaporate contaminants deposited on the window.

Even though such technologies may mitigate the problems caused by contaminants in the vacuum chamber, there is still a need for improved X-ray sources allowing for improved monitoring and control of the number of particles produced from the liquid target.

SUMMARY

It is an object of the present invention to provide an X-ray technology addressing at least some of the above shortcomings. A particular object is to provide a method and an X-ray source allowing for improved monitoring and control of the amount of vapour generated from the liquid target.

Hence, according to a first aspect, there is provided a method for generating X-ray radiation. The method comprises providing a liquid target and directing an electron beam towards the liquid target such that the electron beam interacts with the liquid target to generate X-ray radiation. Further, a number of particles produced from the interaction between the electron beam and the liquid target is estimated. This estimation may be used for controlling the electron beam, and/or a temperature in a region of the liquid target in which the electron beam interacts with the liquid target, such that the estimated number of particles is below a predetermined limit.

According to a second aspect, an X-ray source is provided, comprising a liquid target source configured to provide a liquid target, an electron source adapted to provide an electron beam directed towards the liquid target such that the electron beam interacts with the liquid target to generate X-ray radiation, and an arrangement adapted to measure a number of particles produced from the interaction between the electron beam and the liquid target. Further, the electron source may be controllable based on the measured number of particles. Additionally, or alternatively, the liquid target source may be operable to control a temperature in a region of the liquid target, in which region the electron beam interacts with the liquid target.

The present aspects are generally concerned with monitoring and control of vapour generated during operation of the X-ray source, which allows for the operation of the X-ray source to be controlled and adjusted accordingly. Vaporisation of X-ray targets is a well-known phenomenon where a critical parameter is the vapour pressure. For the case of a solid target, where vapour may be generated by sublimation, this may be a cause for target deterioration. However, a liquid target has the possibility to regenerate, and thus a certain degree of vaporisation may be allowed without impairing the performance of the X-ray source. The vaporisation results in material leaving the target and travelling through the chamber in the form of free particles, such as e.g. atoms, droplets or debris. They may eventually deposit or adsorb to various surfaces such as e.g. the X-ray window, the electron source and other parts that are critical to the operation and performance of the X-ray source. It is therefore of interest to monitor and control the amount of vapour generated during operation, and also the amount of vapour present in the chamber.

As the degree of vaporisation of the liquid depend, inter alia, on the vapour pressure of the material of the liquid target, the temperature of the liquid target, and in particular the size of the heated surface area of the liquid target, the vaporisation from the target may be controlled by varying the heat induced in the liquid by the electron beam. The induced heat may e.g. be varied by changing the spot size at the interaction region, the electron current of the beam, or a focus of the beam. Alternatively, or additionally, the temperature of the liquid target at the interaction region may be controlled by e.g. cooling the material of the liquid target, or supplying new material, of a different temperature, to the interaction region. Thus, by obtaining a measure or indication of the number of particles produced from the interaction between the electron beam and the liquid target and adjusting the electron beam or liquid target accordingly, the vaporisation rate may be kept at a desired level.

The vapour may comprise charged particles, such as positively charged particles or ions, that are generated upon the interaction between the electron beam and the liquid target. The number of particles, and hence the vaporisation, may therefore be measured as a current. Other alternatives are however conceivable, including measuring a deposition rate, i.e., the amount of material that is deposited on a surface during a certain period of time. Another alternative, or additional option, is to detect the X-ray radiation generated from interaction between the electron beam and particles present in the chamber. This may e.g. be realised by an X-ray sensor, such as e.g. a diode. Further alternatives and examples will be described below in connection with embodiments of the invention.

In the context of the present application, the term 'particles', 'contaminants' and 'vapour' may refer to free particles, including debris, droplets and atoms, generated during operation of the X-ray source. These terms may be used interchangeably throughout the application. The particles may thus be generated due to a phase transition of the material of the liquid target to vapour. Evaporation and boiling are two examples of such a transition. Boiling may occur at or above the boiling temperature of the liquid, whereas evaporation may occur at temperatures below the boiling temperature for a given pressure. Evaporation may occur when the vapour pressure at the surface of the target is not balanced by e.g. the ambient pressure in the chamber. Further, particles such as e.g. debris may be generated by e.g. splashing, heavy impacts or turbulence of the liquid. Thus, it is realised that the particles referred to in the claims are not necessarily limited to particles originating from a vaporisation process. It will be realised that the present inventive concept may relate to estimation of a vaporisation rate from the liquid target, which e.g. may be measured as an amount of material leaving the target per time unit, and/or to estimation of an amount of material present in the chamber (e.g. in the form of particles) at a given point in time.

It will be appreciated that the liquid for the target may be a liquid metal, preferably with low melting point, such as e.g. indium, tin, gallium, lead or bismuth, or an alloy thereof. Further examples of liquids include e.g. water and methanol.

The term 'liquid target' or 'liquid anode' may, in the context of the present application, refer to a liquid jet, a stream, or flow of liquid being forced through e.g. a nozzle and propagating through the interior of the vacuum chamber. Even though the jet in general may be formed of an essentially continuous flow or stream of liquid, it will be appreciated that the jet additionally, or alternatively, may comprise or even be formed of a plurality of droplets. In particular, droplets may be generated upon interaction with the electron beam. Such examples of groups or clusters of droplets may also be encompassed by the term 'liquid jet' or 'target'. Alternative embodiments of liquid target may include multiple jets, a pool of liquid either stationary or rotating, liquid flowing over a solid surface, or liquid confined by solid surfaces.

The estimation of the number of particles, which may be considered to correspond to the amount of debris produced from the interaction between the electron beam and the liquid target, may be improved by eliminating a contribution from scattered electrons. The elimination of the contribution from scattered electrons may in some examples be achieved by subtracting a current generated by the scattered electrons from a current generated by the positively charged particles. Alternatively, or additionally the elimination of the contribution from the scattered electrons may be achieved by hindering or preventing the electrons from reaching the sensor or arrangement measuring the number of positively charged particles. The scattered electrons may thus be hindered from interfering with the measurements of the of positively charged particles, thereby allowing for an improved and more accurate estimation of the number of particles, or amount of debris, produced from the generation of the X-ray radiation.

It will be realised that the term "eliminating" may refer to a process of compensating for or reducing the effects of scattered electrons that may be present in the chamber. The present disclosure is therefore not necessarily limited to a complete exclusion or removal of the contribution from scattered electrons. Instead, it is appreciated that an improved technology for generating X-ray radiation may be achieved by taking into account the contribution from electrons to the measurements of the charged particles in the chamber.

According to an embodiment, the estimated number or particles produced from the interaction between the electron beam and the liquid target may be a measure of the vaporisation rate of the liquid target. By knowing the vaporisation rate, the operation of the X-ray source may be adjusted accordingly to keep the vaporisation within a preferred range.

According to an embodiment, the estimated number or particles produced from the interaction between the electron beam and the liquid target may be a measure of an amount of liquid target material present in the chamber, e.g. in the form of particles in the chamber. Thus, the estimated number of particles may be used for indicating a total or accumulated amount of material evaporated from the liquid target.

According to an embodiment, the number of particles may be estimated by measuring a current generated by positively charged particles from the interaction between the electron beam and the liquid target. This may e.g. be achieved by means of a particle trap, which may be adapted to be connected to a negative electric potential so as to attract at least some of the positively charged particles, and a measuring device for measuring a trap current generated by the attracted particles. An alternative embodiment may comprise a trap that is connected to ground, i.e. a trap without a negative bias. This embodiment relies on the fact that the positively charged particles may be given trajectories guiding them onto the trap, since there is no electric potential that may attract the particles. On the other hand, the implementation may be simpler since the trap may not need to be electrically isolated from a chamber housing.

According to an embodiment, an arrangement for deflecting, collecting or blocking scattered electrons, which for example may originate from the interaction with the liquid target, may be employed to reduce the number of electrons interfering with the measurement of the positively charged particles. This may for example be achieved by deflecting the scattered electrons away from the above mentioned particle trap.

According to an embodiment, a current generated by scattered electrons may be measured. This may e.g. be achieved by means of a particle repeller adapted to be connected to a positive electric potential so as to deflect positively charged particles and, possibly, to attract scattered electrons. Advantageously, the shape of the repeller may be selected with the aim of optimising the surface area onto with the electrons may collide. This also applies to the location of the repeller, which may be selected so as to allow as many electrons as possible to impinge on the repeller. The repeller current generated by the attracted or impinging electrons may be measured by a measuring device connected to the particle repeller.

Thus, according to some embodiments, the particle sensor of the X-ray source may comprise a particle trap, a particle repeller and one or several measuring devices for measuring the trap current and the repeller current as described above. The particle sensor may further comprise a processing device, or processing circuitry, configured to estimate the number of particles based on the trap current and the repeller current.

Even though the magnitude of the trap current may give an indication of the amount of charged particles interacting with the particle trap, these measurements may, as discussed above, be disturbed by backscattered electrons, reducing the accuracy and performance of the operation of the X-ray source. This issue may be addressed by measuring the repeller current, which may be used as a measure of the number of backscattered electrons in the chamber, and thus as a correction factor to be taken into account when estimating the number of particles based on the trap current. In other words, the electron current absorbed in the particle repeller may be used to estimate the contribution from backscattered electrons to the trap current, which in turn is a measure of the rate of particle generation (or vapour generation) in the interaction region. Due to the correction factor, a more accurate estimation of the particle generation may be obtained.

The particle trap may be realised as an electrically conductive element, such as e.g. a conductive plate or shield, having a surface towards which positively charged particles may be accelerated by means of an electric field. The electric field may e.g. be generated by an electric potential difference applied to the particle trap. The electric potential difference should thus be selected such that positively charged particles are attracted to the trap and, preferably, deposited or adsorbed at the trap. The electric potential difference may thus have a negative sign relative to ground or to the positively charged particles, and may also, in the context of the present application, be referred to as a negative electric potential. It will however be appreciated that the particle trap may as well be connected to ground, i.e., be provided with a zero potential. In such case, it may be advantageous to provide the trap with a physical shape and location that increases the interactions with the particles, or, in other words, such that it is hit by as many particles as possible, to compensate for the lack of electrostatic attraction.

The particle trap may be adapted to be replaced when a certain amount of material has accumulated on the trap. Thus, the particle trap may be considered as a consumable which may be replaced on a regular basis so as to ensure a required performance.

The particle repeller may be realised as an electrically conductive element, such as e.g. a conductive plate or shield that may be similarly configured as the particle trap. The particle repeller should however be configured such that positively charged particles may be accelerated or deflected away from the repeller. This may be achieved by an electric potential difference causing an electric field that diverts the positively charged particles from the repeller. The electric potential difference may thus be selected to have a positive sign relative to ground or the positively charged particles, and may also, in the context of the present application, be referred to a positive electric potential. The particle repeller may be used for deflecting particles from trajectories that otherwise would allow them to pass towards the electron source.

The electron beam may be controlled such that the estimated number of particles in the chamber is maintained below a predetermined limit, which may be a limiting value set to ensure safe and stable operation of the X-ray source. This may e.g. be realised by means of a controller or circuitry that is operably connected to the electron source and configured to vary e.g. the current and/or intensity of the generated electron beam. Alternatively, or additionally, the controlling of the electron beam may involve an electron-optical system for varying the focus or spot size of the electron beam, and/or deflecting the electron beam relative the interaction region. The aim of the controlling may be to keep the generation of particles in the interaction region below a certain limit or threshold, and thereby to maintain the rate of contamination of e.g. the window at a desired level.

An alternative, or complement, to controlling the electron beam may be to control the liquid target so that it may generate less vapour for a given electron beam configuration. This may be realised e.g. by increasing a speed of the target in a direction essentially perpendicular to the direction for the electron beam (in case the target is a liquid jet), or by inducing mixing of the target material. In this way, new material of lower temperature may be added to the target thus resulting in less vapour being produced.

The electron beam and/or the liquid target may be controlled based on the estimated number of particles in the chamber. The control may be effected in a similar manner as described above, using the estimated particle level as an input or reference data for the controlling. Thus, the estimated number of particles may be used for verifying or monitoring the rate of vaporisation in the chamber, and the electron beam and/or the liquid target adjusted accordingly so as to keep the number of particles below the predetermined limit.

The limit may e.g. be determined based on empirical studies of acceptable particle levels for specific systems, desired maintenance intervals, operational modes of the X-ray source, or performance requirements.

The particle repeller and/or particle trap may be arranged in the close vicinity of the path of the electron beam, so as to prevent particles from migrating towards the electron source or cathode. In some examples, the chamber accommodating the interaction region may be separated or sealed off from the region in which the electron source is located. The two regions may communicate, inter alia, via an aperture or aperture means that at least partly encloses a portion of the path of the electron beam. In such configurations, the repeller and/or the particle trap may be arranged in the immediate vicinity of the aperture so as to prevent particles from entering the region in which the electron source is located.

According to an embodiment, the particle repeller may be arranged between the electron source and the particle trap. Thus, the repeller may act as a backup deflecting any particles that succeed to escape the trap on their way towards the electron source. Further, the particle repeller may provide an electric field that is configured to direct particles towards the particle trap. This may be of particular importance in case the particle trap is grounded and therefore not capable to attract particles by its own means.

According to an embodiment, the particle trap, the particle repeller, and the aperture, which may be arranged between the electron source and the particle repeller, may be arranged to protect electron source from particles generated in the interaction region. In this way three obstacles are provided, which the particles need to pass on their way towards the electron source.

Advantageously, the particle repeller may be arranged in close vicinity of the particle trap. This allows for the particle repeller to absorb or catch backscattered electrons that otherwise would risk disturbing the trap current measured at the particle trap.

According to some embodiments, at least a surface of the aperture means or a surface at least partially surrounding the aperture may be coated with an electron-absorbing material to reduce the number of electrons that are backscattered from the aperture. Alternatively, or additionally, an electron-absorbing material may be provided on a surface or surface portion of the particle repeller. The electron-absorbing material allows for a reduction of the number of backscattered electrons interacting with the particle trap and may hence improve the accuracy of the estimation of the number of particles in the chamber.

The electron-absorbing material may be understood as a material that has an improved capability of absorbing electrons, or preventing them from scattering from the material, as compared to the material surrounding the aperture and/or forming the particle repeller. Graphite is an example of an electron-absorbing material, which may be provided in the form of a thin layer or coating.

According to an embodiment, the means for eliminating a contribution from scattered electrons may involve an arrangement or methodology for sensing or characterising charged particles, such as electrons, in the chamber of the X-ray source. Suitable techniques for characterising the contribution from scattered electrons may for example include a Wien filter, utilizing perpendicular electric and magnetic fields to retrieve information of the electrons, and semiconductor based sensors such as charge-coupled devices.

Alternatively, or additionally, the contribution from scattered electrons may be estimated by consulting table of reference data. The table may for example comprise data indicating an estimated contribution from scattered electrons for certain system parameters or operational parameters, such as current and acceleration voltage of the electron source, spot size of the electron beam at the target, thermal load on the target, etcetera. These data may be determined in a prior calibration process and/or estimated through calculations. This allows for a controller of the X-ray source to request data correlated to a specific operation condition and use the data as a correction factor when determining the number of particles produced from the interaction between the electron beam and the target.

According to an embodiment, the particle sensor of the X-ray source may comprise a measuring element for measuring an amount of deposited material formed by particles produced in the interaction region. The measuring element may be used in addition, or as an alternative to the particle trap and the particle repeller. The measuring element may e.g. comprise a surface onto which the material may deposit in the form of e.g. a layer. The amount of material, e.g. measured as a thickness of the layer, may be used for estimating an amount of material in the chamber. The deposited amount of material may e.g. be monitored over a certain period of time so as to estimate the total amount of material present in the chamber during the same period of time. Further, the thickness of the layer may be used as an indication of the thickness of material contaminating e.g. the window. For this purpose, it may be advantageous to orient a surface of the measuring element close to, and/or in the same direction as, the inner surface of the window. The estimated level of contamination of the X-ray window allows for more efficient maintenance of the X-ray source, since the risk of a too early or too late replacement of the window may be reduced.

It will however be appreciated that the measuring element may be located at other positions in the chamber, such as e.g. close to or around the path of the electron beam, the aperture means, the particle repeller and/or the particle trap. It is further conceivable that the measuring element forms a structurally integrated part of any of the aperture means, the particle trap and the particle repeller, or is formed of any of these elements.

According to an embodiment, the measuring element may be adapted to oscillate. Thus, a thickness or amount of the material deposited on the measuring element may be estimated by measuring a resonance frequency of the measuring element, utilising the fact that the resonance frequency tends to vary with the mass and physical dimensions of an oscillating element.

According to an embodiment, the measuring element may be formed of a piezoelectric element. Examples of such elements include e.g. quartz crystal monitoring devices (QCMs). The QCM uses a metallised piezoelectric crystal which may be driven to oscillate. Piezoelectric elements are advantageous in that they may provide a measurements of a high accuracy and sensistivity.

Alternatively, or additionally, the particle sensor may comprise a mass spectrometer for determining vapour rate for different constituents of the liquid target. This added information may be used to detect changes in composition of the target, e.g. if the target comprises two elements, and one of these is overrepresented in the vapour, it may be inferred that the remaining target material composition has changed. The X-ray source may be provided with separate material containers containing the elements comprised in the target and a control system that ensures proper target composition based on the results from the mass spectrometer.

Another alternative or addition would be to let the particle sensor comprise at least one X-ray diode arranged for detecting X-ray radiation produced by interaction between the electron beam and particles present in the chamber. To accomplish this detection, the diode may be strongly collimated, i.e. filter out radiation originating from interaction between the electron beam and the liquid target. Furthermore, the diode could be provided with energy discrimination, i.e. configured to mainly detect the X-ray radiation originating from interaction between the electron beam and the elements comprised in the liquid target. An advantage with using X-ray diodes is that they can be placed outside of the vacuum chamber, which makes the overall system design less complex.

In an ideal system, the electron beam may interact with the liquid target in absolute vacuum. However, in reality there is often some ambient gas present. The amount of gas tends to decrease during initial system usage and reach a steady state after some time, where the amount of gas generated from different components within the system may be balanced by the pump capacity. The presence of ambient gases may interfere with the intention of monitoring the rate of vapour production from interaction between the electron beam and the liquid target. Ambient gas may be ionized by direct interaction with the electron beam and by interaction with backscattered electrons, wherein the latter process in most cases exhibits a higher ionisation cross section. The contribution from the ambient gas to the measured signal may be either minimized or compensated for. To estimate the contribution to the ionic current from the ambient gas, a reference measurement may be performed. One example of such a measurement is to use a highly defocused electron beam, thus depositing a comparatively small amount of energy in the liquid target and thereby generating no or almost no vapour. The signal measured for this configuration may then be assumed to originate from the ambient gas and used as an offset correction for future measurements. Alternatively, the knowledge that ambient gas moves with a low velocity compared to the vapour generated from interaction between the electron beam and the liquid target may be used to provide active filtering, e.g. by providing a Wien filter preventing low velocity ions from reaching the ion trap. In case a mass spectrometer is used for detecting vapour, the ambient gas contribution may be measured directly provided that the constituents are elements not present in the target. Yet another embodiment may comprise a separate vacuum sensor arranged not to be affected by vapour generated from the target, wherein said sensor may provide a signal that can be used to compensate the result from the particle sensor for an ambient gas contribution.

According to an embodiment wherein the liquid target is provided as a liquid jet, the X-ray source may further comprise, or be arranged in, a system comprising a closed-loop circulation system. The circulation system may be located between the collection reservoir and the target generator and may be adapted to circulate the collected liquid of the liquid jet and/or the additional liquid to the target generator. The closed-loop circulation system allows for continuous operation of the X-ray source, as the liquid may be reused. The closed-loop circulation system may be operated according to the following example:

- The pressure of liquid contained in a first portion of a closed-loop circulation system is raised to at least 10 bar, preferably at least 50 bar or more, using a high-pressure pump.
- The pressurised liquid is conducted to a nozzle. Although any conduction through a conduit will entail some, possibly negligible under the circumstances, loss of pressure, the pressurised liquid reaches the nozzle at a pressure still above 10 bar, preferably above 50 bar.
- The liquid is ejected from the nozzle into a vacuum chamber, in which the interaction region is located, for generating a liquid jet.
- The ejected liquid is collected in a collection reservoir after passage through the interaction region.
- The pressure of the collected liquid is raised to a suction side pressure (inlet pressure) for the high-pressure pump, in a second portion of the closed-loop circulation system located between the collection reservoir and the high-pressure pump in the flow direction (i.e., during normal operation of the system, liquid flows from the collection reservoir towards the high-pressure pump). The inlet pressure for the high-pressure pump is at least 0.1 bar, preferably at least 0.2 bar, in order to provide reliable and stable operation of the high-pressure pump.

The steps are then typically repeated continuously—that is, the liquid at the inlet pressure is again fed to the high-pressure pump which again pressurises it to at least 10 bar etc.—so that the supply of a liquid jet to the interaction region is effected in a continuous, closed-loop fashion.

In some implementations, the X-ray source may be arranged in a system wherein the liquid may be passed through one or more filters during its circulation in the system. For example, a relatively coarse filter may be arranged between the collection reservoir and the high-pressure pump in the normal flow direction, and a relatively fine filter may be arranged between the high-pressure pump and the nozzle in the normal flow direction. The coarse and the fine filter may be used separately or in combination. Embodiments including filtering of the liquid are advantageous in so far as solid contaminants are captured and can be removed from the circulation before they cause damage to other parts of the system.

The technology disclosed may be embodied as computer readable instructions for controlling a programmable computer in such manner that it causes an X-ray source to perform the method outlined above. Such instructions may be distributed in the form of a computer-program product comprising a non-volatile computer-readable medium storing the instructions.

It will be appreciated that any of the features in the embodiments described above for the method according to the first aspect above may be combined with the X-ray source according to the second aspect of the present invention, and vice versa.

Further objectives of, features of, and advantages with the present invention will become apparent when studying the following detailed disclosure, the drawings and the appended claims. Those skilled in the art will realize that different features of the present invention can be combined to create embodiments other that those described in the following

BRIEF DESCRIPTION OF THE DRAWINGS

The invention will now be described for the purpose of exemplification with reference to the accompanying drawings, on which.

All figures are schematic, not necessarily to scale, and generally only show parts that are necessary in order to elucidate the invention, wherein other parts may be omitted or merely suggested.

DETAILED DESCRIPTION OF EMBODIMENTS

Figure 1:
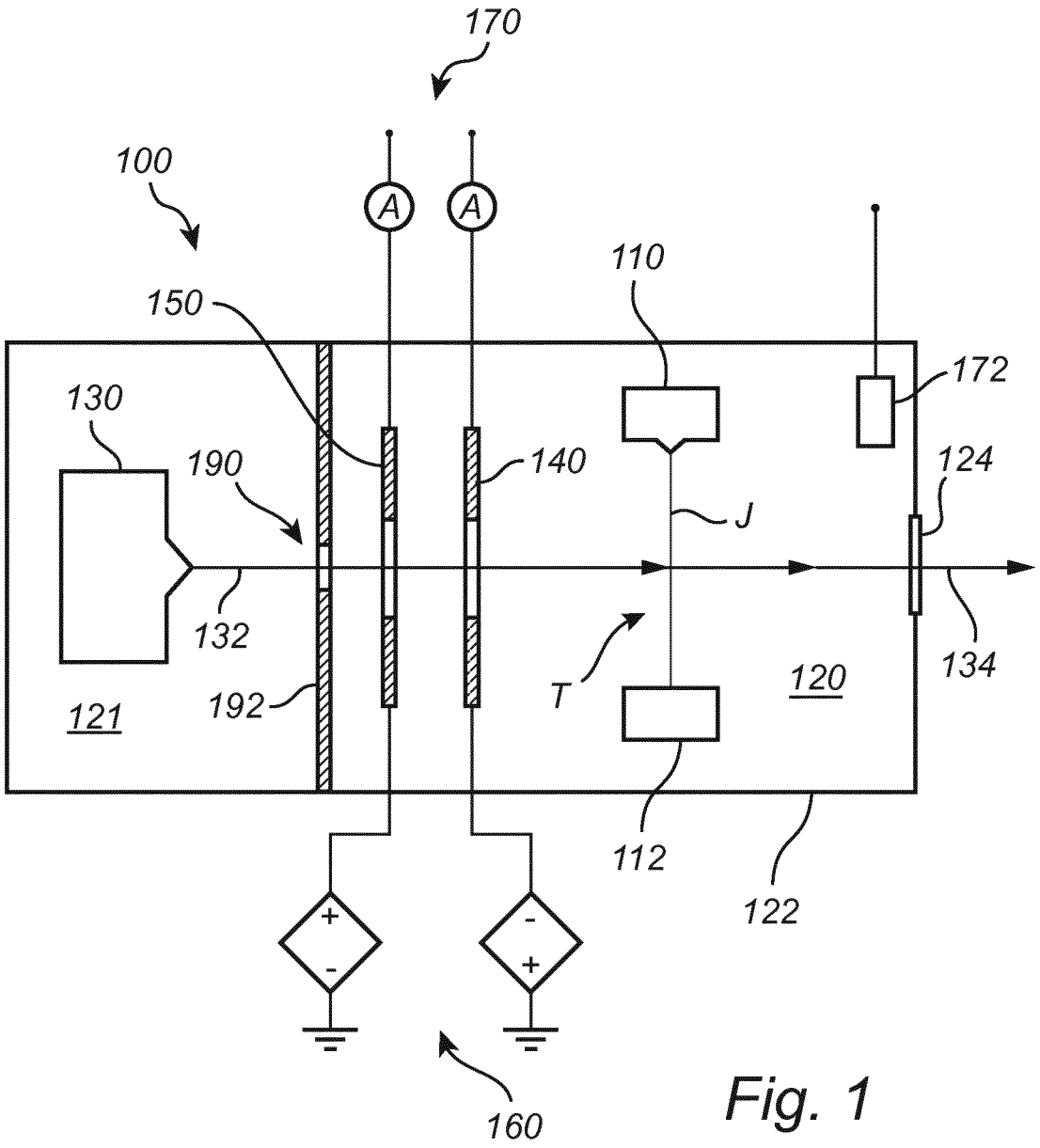
FIG. 1 is a schematic, cross sectional side view of an X-ray source according to some embodiments of the present invention.

An X-ray source 100 according to an embodiment of the invention will now be described with reference to FIG. 1. As indicated in FIG. 1, a vacuum chamber 120 may be defined by an enclosure 122 and an X-ray transparent window 124 that separates the vacuum chamber 120 from the ambient atmosphere. The X-rays 134 may be generated from an interaction region T, in which electrons from an electron beam 132 may interact with a target J.

The electron beam 132 may be generated by an electron source 130, such as an electron gun 130 comprising a high-voltage cathode, directed towards the interaction region T. The electron beam 132 may follow a trajectory, or path, between the electron source 130 and the interaction region T, wherein the trajectory may be adjusted by electron-optical means and/or the configuration of the electron source. The electron source may further be controllable so as to allow for parameters of the electron beam to be adjusted, such as e.g. beam current, intensity, width, height and electron energy. Furthermore, the electron source may be arranged to provide a plurality of electron beams.

According to the present embodiment, the target may e.g. be formed of a liquid jet J intersecting the interaction region T. The liquid jet J may be generated by a target generator 110 comprising a nozzle through which e.g. fluid, such as e.g. liquid metal may be expelled to form the jet J propagating towards and through the interaction region T. Alternatively, the liquid target J may be formed of e.g. multiple jets, a liquid reservoir or pool, which may be stationary or rotating, or a liquid curtain or sheet that may float on a surface or freely within the chamber. In some examples, the jet J may be collected by a reservoir or pool.

The X-ray source 100 may further comprise a closed loop circulation system (not shown) located between a collection reservoir 112 for collecting the material of the liquid jet J and the target generator 110. The closed-loop system may be adapted to circulate the collected liquid metal to the target generator 110 by means of a high-pressure pump adapted to raise the pressure to at least 10 bar, preferably at least 50 bar or more, for generating the target jet J.

Further, the X-ray source may comprise a particle sensor for measuring a number of particles present in the chamber and/or produced from the liquid target. The particle sensor may e.g. be implemented as one or several electrical sensors measuring a current, and/or as a sensor for measuring an amount of material deposited on a specific surface within the chamber. In the present figure, several examples of implementations of the particle sensor are indicated. Each one of the illustrated examples may be used separately or combined with each other. In a first example, the particle sensor comprises a particle trap 140 for collecting particles present in the chamber 120. The particle trap 140 may e.g. be formed of an electrically conductive element that may be connected to a voltage source 160 for applying an electric potential, such as e.g. a negative electric potential difference, to the particle trap 140. FIG. 1 shows a cross section of a particle trap 140 formed as a plate with an aperture that is arranged to enclose the electron beam 132 and thereby capture charged particles, such as e.g. positively charged debris and vapour from the interaction region T, on their way towards the electron source 130. The particles may be accelerated towards a surface of the particle trap 140, at which they may be deposited or adsorbed. The plate may e.g. be formed of stainless steel or other electrically conductive materials.

In a second example of the particle sensor, a particle repeller 150 may be provided. The particle repeller may be formed of an electrically conductive element operating at an electrical potential for deflecting or repelling positively charged particles in the vicinity of the repeller 150. The repeller may in some examples be similarly configured as the particle trap 140, i.e., comprising a plate with an aperture enclosing the electron beam 132, and may preferably be used in combination with the particle trap 140. Such an example is illustrated in the present figure, in which the repeller is located along the path of the electron beam 132 and between the particle trap 140 and the electron source 130. Similar to the particle trap 140, the repeller may be electrically connected to a voltage source 160 producing the electric potential difference required for achieving the particle repelling effect. The repeller may e.g. be formed of stainless steel or other electrically conductive materials.

The particle repeller may be combined with an aperture means 190, which may be arranged in a plate or wall element 192 delimiting the chamber region 120 and the cathode region 121 of the X-ray source 130, to protect the electron source 130 from particles (such as debris and vapour) generated in the chamber 120. Thus, the particle repeller 150 may be arranged between the aperture 190 and the particle trap so as to prevent particles that manage to pass the particle trap from reaching the aperture 190 (and eventually the electron source 130).

A further embodiment may include an aperture between the particle repeller and the particle trap to reduce the number of electrons backscattering from the ion repeller that reaches the ion trap. The aperture may hence act as a means for eliminating a contribution from at least some scattered electrons to the measurements of the ions. An electric field may be provided for guiding the ions towards the ion trap, and may be modified accordingly to provide for a large ionic current in the ion trap.

In a third example of the particle sensor, a measuring element 172 may be provided for measuring an amount of deposited material formed by particles produced in the interaction region T. The measuring element 172 may e.g. be an oscillating device, such as e.g. a crystal monitoring device, for which the resonance frequency may be varied according to a thickness (or amount) of the deposited material. In the present example illustrated in FIG. 1, the measuring element 172 may be a quartz crystal monitoring device (QCM) arranged in the vicinity of the X-ray window 124 and facing the interaction region J to provide an indication of the amount of material that may have deposited on the X-ray window 124, and thus an indication of when it is time to replace or clean the window 124. The measuring element 172 may be used instead of the particle trap 140 and the particle repeller 150, or in combination with these elements.

Although the particle trap 140, the particle repeller 150 and the aperture 190 are aligned along the path of the electron beam 132 in the present figure, other configurations are conceivable as well. Alternative (or additional) locations of the particle trap 140 and/or repeller 150 may e.g. include the close vicinity of the X-ray window 124, or the interaction region T.

The voltage source 160 may be arranged outside the chamber 120 and connected to the particle trap 140 and the particle repeller 150 via electrical feedthroughs. The voltage source 160 may be common to both the particle trap 140 and the particle repeller 150, and capable of supplying both with the required voltage, or comprise two separate and preferable individually controllable voltage sources 160—one for the particle trap 140, and one for the particle repeller 150. The voltage source 160 may be operated by a controller circuitry (not shown) adapted to generate a desired electric potential difference at the particle trap 140 and particle repeller 150, respectively. The electric potential difference may be varied based on e.g. the rate at which the particles are generated in the chamber, and the type and amount of material captured by the trap.

The X-ray source 100 may further comprise (or be operably connected to) means, such as e.g. ammeters 170, for measuring a trap current $I_T$ generated in the particle trap 140, and a repeller current $I_R$ generated in the particle repeller 150. The trap current $I_T$ may be used as a measure of the number of particles (such as positively charged particles or ions) that are captured by the particle trap 140, and thus give an indication of the amount of vapour (or number of particles) currently present or generated in the chamber 120. The repeller current $I_R$, on the other hand, may be used as a measure of the number of backscattered electrons that are attracted and captured by the positively biased particle repeller 150. This measure can be used for determining a correction factor that corresponds to the contribution from backscattered electrons to the trap current $I_T$ and can be used for a more accurate estimation of the number of particles in the chamber 120. In other words, the repeller current $I_R$ may be used to eliminate or at least reduce a contribution from scattered electrons to the estimated number of particles. It will be appreciated that the voltage source 160 and the ammeter 170 may be combined in a common unit. In one example, the voltage source 160 may be configured keep the particle trap 140 and/or the repeller 150 at a relatively constant bias. This allows for the trap current $I_T$ and/or the repeller current $I_R$ to be detected as fluctuations or disturbances in the bias caused by the impinging particles and/or electrons.

Figure 2:
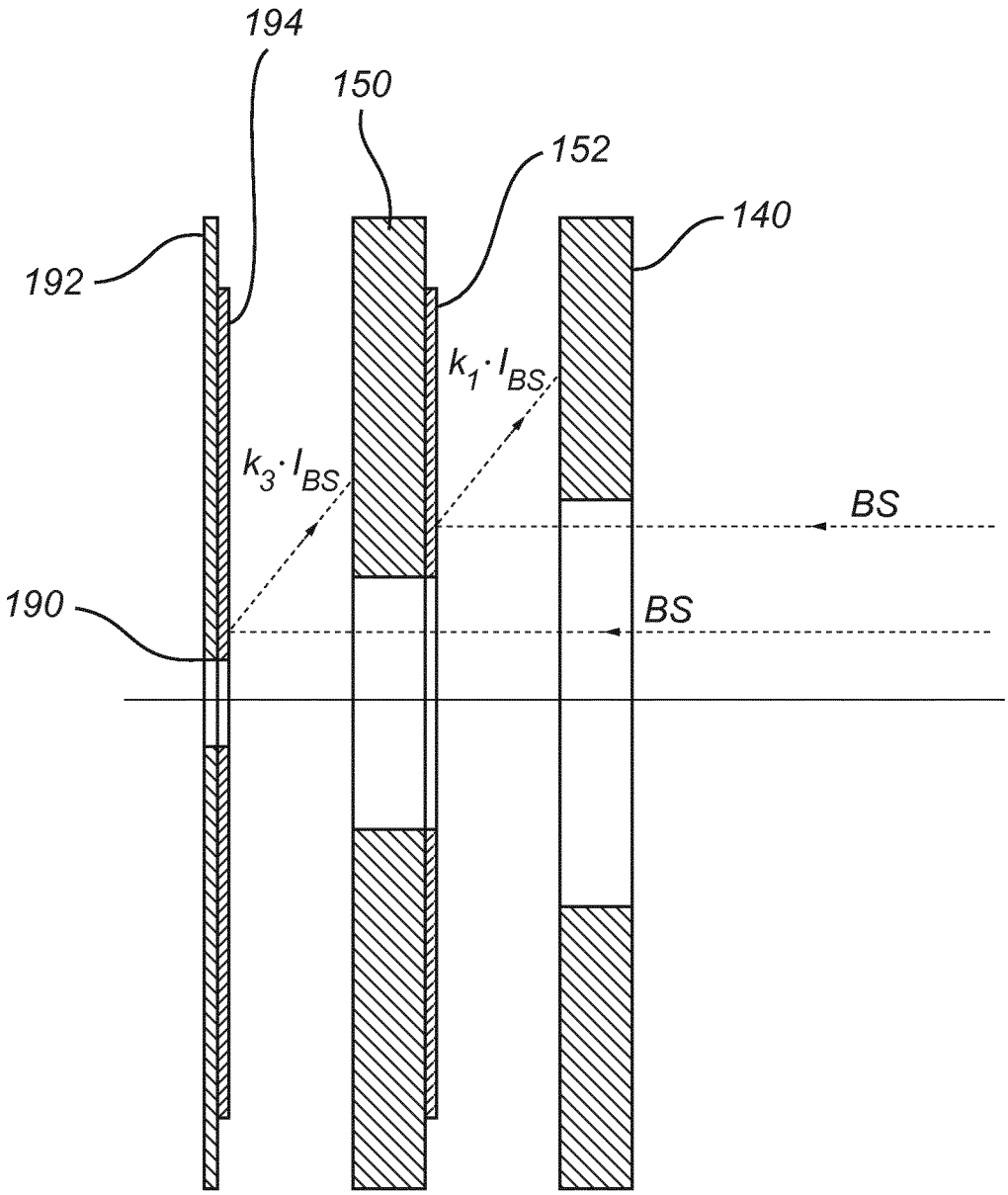
FIG. 2 is a partial view of an X-ray source according to FIG. 1 wherein the effect of backscattered electrons is illustrated.

FIG. 2 illustrates the effects of backscattered electrons BS that are present in the chamber 120 and, in their turn, are backscattered against surfaces of the particle repeller 150 and the aperture 190 in an X-ray source 100 that may be similarly configured as the one described above with reference to FIG. 1. The influx of backscattered electrons BS may be considered as a current $I_{BS}$, which can be used to estimate the contribution of electrons to the measured trap current $I_T$ and repeller current $I_R$. The measured trap current $I_T$ may be estimated as the sum of the positive current $I_{ion}$ generated by ions trapped in the particle trap 150, and the negative contribution $k_1 \cdot I_{BS}$ of electrons originating from backscattered electrons BS that are backscattered again from the particle repeller 150 and interacts with the particle trap 140. The factor $k_1$ represents in this case the fraction of those electrons BS that are backscattered again from the particle repeller and captured by the trap. Thus, the trap current $I_T$ may be expressed as:

$$I_T = I_{ion} + k_1 \cdot I_{BS}$$

Further, the repeller current $I_R$ may be estimated by considering the number of backscattered electrons BS that are absorbed by the particle repeller 150, denoted $k_2 \cdot I_{BS}$, and the number of backscattered electrons BS that backscatter at the surface 192 surrounding the aperture 190 and are absorbed by the repeller. This contribution may be denoted $k_3 \cdot I_{BS}$. Thus, the repeller current $I_R$ may be expressed as:

$$I_R = (k_2 + k_3) \cdot I_{BS}$$

where $k_2$ is the fraction of backscattered electrons that is absorbed in the particle repeller 150 and $k_3$ the fraction that is backscattered from the aperture means 190 and then absorbed in the particle repeller.

The estimation of the trap current $I_T$ may be improved by reducing the fraction of electrons that are backscattered from the particle repeller 150, i.e., $k_1$. This allows for the relative contribution from the positive current $I_{ion}$ to be increased compared to the contribution from electrons backscattered from the particle repeller 150. This may be achieved by providing an electron-absorbing material 152, e.g. in the form of a coating, on the particle repeller 150. As a consequence, the factor $k_2$, representing the fraction of backscattered electrons that is absorbed by the particle repeller, may be increased.

The estimation of the trap current $I_T$ may also be further improved by reducing $k_3$ relative to $k_2$. This may be achieved by arranging electron-absorbing material 194 on the aperture means 190 so that the fraction of backscattered electrons BS that are backscattered from the aperture means 190 may be reduced.

The above examples disclose direct measurements of the effect of backscattered electrons BS. It is however appreciated that the contribution of electrons to the measured trap current $I_T$ and repeller current $I_R$ may, according to other examples, be provided by means of reference data, which for example be retrived by means of a lookup table. The reference data may for example be based on previous measurements or calibrations.

Figure 3:
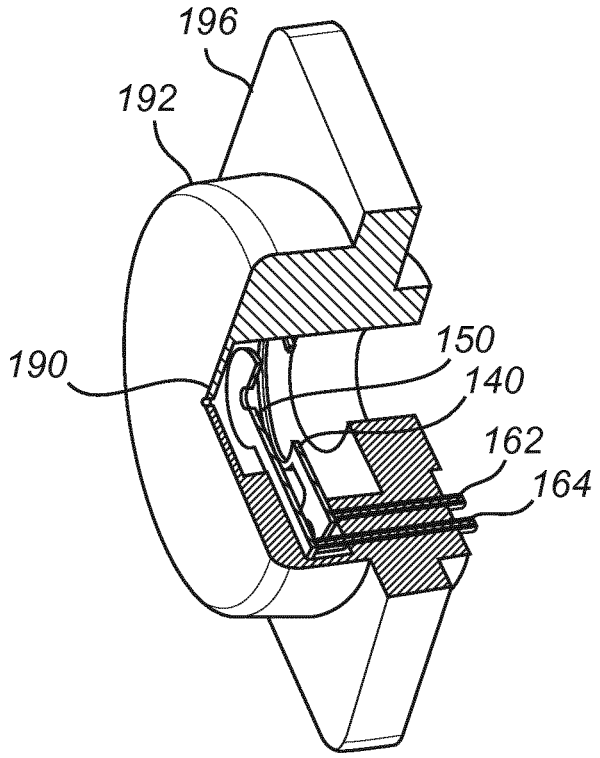
FIG. 3 is a cross sectional perspective view of an aperture, particle trap and particle repeller according to an embodiment.

FIG. 3 show a portion of the X-ray source discussed above in connection with FIG. 1, illustrating an example of the particle trap 140, the particle repeller 150 and the aperture means 190 in further detail. According to the present embodiment, the aperture means 190 may comprise a housing or wall portion 192 for supporting the particle trap 140 and the particle repeller 150 which may be aligned with the aperture 190 along the path of the electron beam. The particle repeller 150 and/or the particle trap 140 may e.g. be ring-shaped or plate-shaped, and may form an aperture or opening arranged around the electron beam. The particle trap 140 and the particle repeller 150 may further be electrically connected to a respective voltage source and current measuring device (not shown) by means of electrical connectors, such as e.g. conduits 162, 164. As indicated in the present example, the particle trap 140 may be geometrically hidden from the line of sight of the interaction region T. This may e.g. be achieved by means of a flange or aperture structure arranged between the particle trap 140 and the interaction region. By arranging the particle trap 140 at such a position, it may be less exposed to backscattered electrons originating from the interaction region T. Further, the particle trap 140 may be provided with a relatively small surface area, especially as compared to the particle repeller 150, so as to further reduce the exposure to electrons and hence increase the quality of the measured particle trap current $I_T$. In an embodiment, the particle trap 140 may be connected to a negative electric potential so as to attract charged particles even though it has a relatively small surface area and even though it is arranged at a somewhat hidden position relative to the line of sight from the interaction region T.

Figure 4:
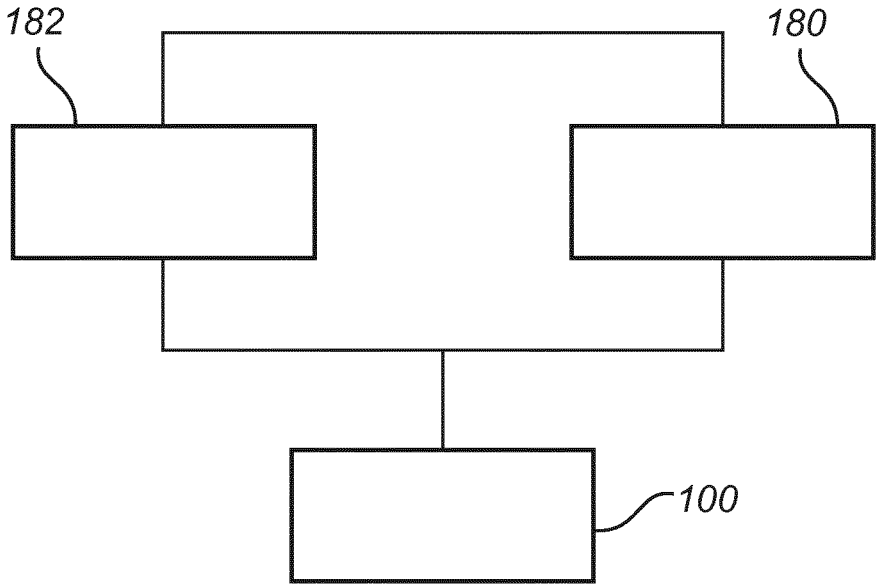
FIG. 4 is a schematic illustration of a system according to an aspect.

FIG. 4 schematically illustrates a system for generating X-rays, comprising an X-ray source 100 according to the embodiments described above in connections with the previous figures, a processing device (or processing circuitry) 180 and a controller (or controlling circuitry) 182. The processing device 180 may be configured to receive information from the measuring device 170 and/or measuring element 172 (shown in FIG. 1), such as e.g. an estimated trap current $I_T$ and repeller current $I_R$, and process the received data in order to estimate e.g. a number of particles present in the chamber. The estimation may e.g. comprise calculations using the correction factors as discussed above in connection with FIG. 2.

The result from the processing device 180 may then be outputted to the controller 182, which may be configured to control the electron source accordingly. The controller may e.g. control the intensity of the electron beam or the temperature of the liquid target to reduce the number of generated particles in case the estimated number of particles e.g. exceeds a predetermined limit. The system may operate according to a feedback loop, in which vapour generated by the interaction between the electron beam and the metal jet of the X-ray source 100 may be determined by the processing device 180 and used by the controller 182 for adjusting the operation of the X-ray source. The adjusted operation may result in a change in the rate of the vapour production, which may be determined by the processing device 180 and transmitted to the controller 182, etcetera.

Figure 5:
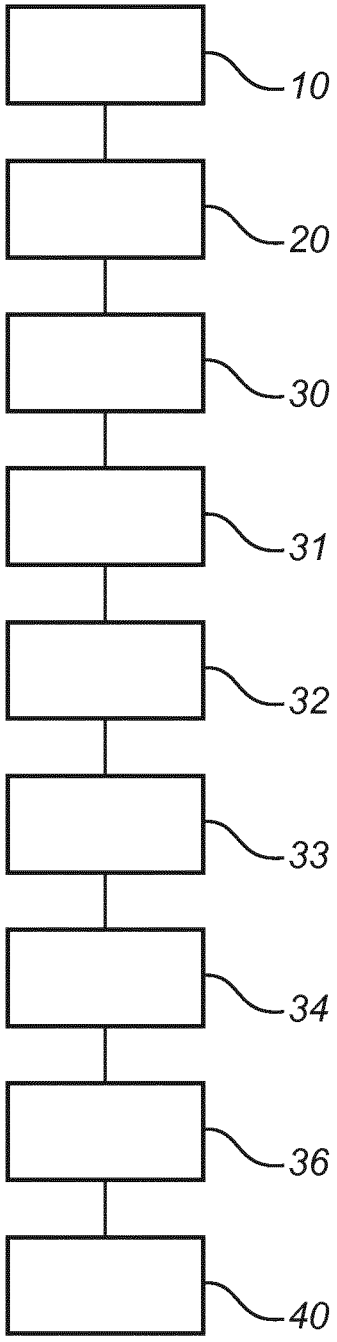
FIG. 5 schematically illustrates a method for generating X-ray radiation according to an embodiment of the present invention.

FIG. 5 is an outline of a method for generating X-ray radiation according to an embodiment of the present invention. The method may e.g. be performed by means of the controller 182 and the processing device 180 described above for FIG. 4 and used for controlling an X-ray source 100 that may be similarly configured as any one of the above embodiments. The method comprises providing 10 the liquid target and directing 20 the electron beam 132 towards the liquid target such that the electron beam 132 interacts with the liquid target to generate the X-ray radiation 134. The method further comprises estimating 30 a number of particles produced from the interaction between the electron beam and the liquid target and controlling 40 the electron beam such that the estimated number of particles are below a predetermined limit.

In the specific example disclosed in the present figure, the step of estimating 30 the number of particles may comprise applying 31 a negative electrical potential to the particle trap 140, and applying 33 a positive electrical potential to the particle repeller 150. By then measuring 32 the trap current $I_T$ generated by positively charged particles interacting with the particle trap, and measuring 34 the repeller current $I_R$ generated by scattered electrons interacting with the particle repeller, the number of particles in the chamber 120 may be estimated based on the trap current $I_T$ and the repeller current $I_R$. The number of particles may be used as input to the controller 182 for controlling 40 e.g. the current, focus or spot size of the electron beam 132, or the temperature of the liquid target J such that the vaporisation rate is kept at a relatively low level.

According to an embodiment, the step of estimating 30 the number of particles may (in addition, or as an alternative) comprise measuring 36 an amount of deposited material on e.g. an oscillating measuring element, wherein the deposited material is formed by the particles produced in the interaction region.

According to an embodiment, the step of estimating 30 the number of particles may (in addition, or as an alternative) comprise measuring 36 an amount of deposited material on e.g. a part of inner wall by measuring an electrical resistance between two electrodes arranged on said wall. Provided the deposited material forms a film on an insulating surface connecting the two electrodes the resistance will be inversely proportional to the film thickness and thus the amount of deposited material. In cases where material leaving the target is in the form of droplets these may deposit on the electrodes and thus create a path for conduction between the electrodes effectively making the electrical resistance approach zero (within the measurement accuracy).

The person skilled in the art realises that the present invention by no means is limited to the examples and configurations described above. On the contrary, many modifications and variations are possible within the scope of the appended claims. For example, the particle trap and the particle repeller may be arranged in other geometric positions. The particle trap and the particle repeller may e.g. be used for protecting the X-ray window from being contaminated, or for protecting other parts and elements within the chamber, in combination with the above described method for estimating the number of particles in the chamber. Further, the applied voltages to the particle trap and particle repeller need not be constant, but may be varied in different ways provided it is effective in limiting or controlling the mobility of particles and/or measuring the number of contaminants. In particular, time-varying electric potentials may be realised, which may provide for more sophisticated ways of diverting particles from unsafe regions (e.g. the vicinity of the aperture or the window) and estimated the rate at which they are produced. Furthermore, means for actively ionizing debris or particles generated from the interaction between the electron beam and the liquid target may be included, thus increasing the fraction of debris or particles directed to the ion trap. An X-ray source utilising such an ionisation tool is disclosed in applicant's European application no. 16175573.1, which is hereby incorporated by reference. Furthermore, X-ray sources and systems comprising more than one liquid jet or more than one electron beam are conceivable within the scope of the present inventive concept. Furthermore, X-ray sources of the type described herein may advantageously be combined with X-ray optics and/or detectors tailored to specific applications exemplified by but not limited to medical diagnosis, non-destructive testing, lithography, crystal analysis, microscopy, materials science, microscopy surface physics, protein structure determination by X-ray diffraction, X-ray photo spectroscopy (XPS), critical dimension small angle X-ray scattering (CD-SAXS), and X-ray fluorescence (XRF). Additionally, variations to the disclosed examples can be understood and effected by the skilled person in practising the claimed invention, from a study of the drawings, the disclosure, and the appended claims. The mere fact that certain measures are recited in mutually different dependent claims does not indicate that a combination of these measures cannot be used to advantage.

The invention claimed is:

1. A method for generating X-ray radiation, comprising:
providing a liquid target in a chamber;
directing an electron beam towards said liquid target such that the electron beam interacts with the liquid target to generate X-ray radiation;
estimating a number of particles produced from the interaction between the electron beam and the liquid target by measuring a number of positively charged particles in the chamber and eliminating a contribution from scattered electrons to the estimated number of particles by measuring a current generated by the scattered electrons; and
controlling said electron beam, and/or a temperature in a region of the liquid target in which the electron beam interacts with said target, such that the estimated number of particles is below a predetermined limit.

2. The method according to claim 1, wherein the estimated number of particles produced from the interaction between the electron beam and the liquid target is a measure of a vaporisation rate of the liquid target.

3. The method according to claim 1, wherein the estimated number of particles produced from the interaction between the electron beam and the liquid target is a measure of an amount of liquid target material present as particles in the chamber.

4. The method according to claim 1, wherein the step of controlling the electron beam comprises varying at least one of a current, a spot size, and focus of the electron beam.

5. The method according to claim 1, comprising forming the liquid target as a jet.

6. The method according to claim 5, wherein the step of controlling the temperature of the liquid target in the interaction region comprises varying a speed of the jet.

7. An X-ray source comprising:
a chamber;
a liquid target source configured to provide a liquid target in the chamber;
an electron source adapted to provide an electron beam directed towards the liquid target such that the electron beam interacts with the liquid target to generate X-ray radiation; and
an arrangement adapted to measure a number of particles produced from the interaction between the electron beam and the liquid target, the arrangement comprising:
a particle sensor adapted to measure a number of positively charged particles in the chamber; and
means for measuring a current generated by scattered electrons in the chamber and based on said current, eliminating a contribution from scattered electrons to the measured number of positively charged particles, wherein:
the electron source is controllable, during operation, such that the estimated number of particles is below a predetermined limit, and/or
the liquid target source is operable to control a temperature in a region of the liquid target, in which region the electron beam interacts with said target, such that the estimated number of particles is below a predetermined limit.

8. The X-ray source according to claim 7, wherein the particle sensor comprises:

a particle trap adapted to collect positively charged particles produced from the interaction with the liquid target;

a particle repeller adapted to be connected to a positive electric potential so as to deflect positively charged particles produced from the interaction with the liquid target;

a measuring device for measuring a trap current ($I_T$) generated by the positively charged particles interacting with the particle trap, and for measuring a repeller current ($I_R$) generated by the scattered electrons interacting with the particle repeller; and a processing device configured to estimate the number of particles based on the trap current and the repeller current.

9. The X-ray source according to claim 8, wherein the particle trap is adapted to be connected to a negative electric potential so as to attract positively charged particles.

10. The X-ray source according to claim 8, wherein the particle trap and the particle repeller are arranged along a path of the electron beam.

11. The X-ray source according to claim 8, further comprising an aperture enclosing the path of the electron beam, wherein the particle repeller is arranged between the electron source and the particle trap and the aperture is arranged between the electron source and the particle repeller.

12. The X-ray source according to claim 11, wherein a surface at least partly surrounding the aperture, and/or a surface of the particle repeller, is coated with an electron-absorbing material.

13. The X-ray source according to claim 12, wherein the electron-absorbing material is graphite.

14. The X-ray source according to claim 7 further comprising a controller adapted to control said electron beam and/or said liquid target source based on the measured number of particles.

15. The X-ray source according to claim 7, wherein the liquid target is provided in the form of a liquid jet.

* * * * *